US011788275B2

(12) United States Patent
Silfverberg

(10) Patent No.: US 11,788,275 B2
(45) Date of Patent: Oct. 17, 2023

(54) METHOD AND MODULE SYSTEM FOR BUILDING A WALL STRUCTURE

(71) Applicant: BLOCK SOLUTIONS OY, Mutala (FI)

(72) Inventor: Markus Silfverberg, Mutala (FI)

(73) Assignee: BLOCK SOLUTIONS OY, Mutala (FI)

( * ) Notice: Subject to any disclaimer, the term of this patent is extended or adjusted under 35 U.S.C. 154(b) by 0 days.

(21) Appl. No.: 17/279,291

(22) PCT Filed: Aug. 21, 2019

(86) PCT No.: PCT/FI2019/050594
§ 371 (c)(1),
(2) Date: Mar. 24, 2021

(87) PCT Pub. No.: WO2020/065125
PCT Pub. Date: Apr. 2, 2020

(65) Prior Publication Data

US 2021/0404176 A1 Dec. 30, 2021

(30) Foreign Application Priority Data

Sep. 25, 2018 (FI) ..... 20185797

(51) Int. Cl.
*E04B 1/58* (2006.01)
*E04B 2/18* (2006.01)
(Continued)

(52) U.S. Cl.
CPC ..... *E04B 1/5831* (2013.01); *E04B 1/08* (2013.01); *E04B 2/18* (2013.01); *E04B 2/20* (2013.01);
(Continued)

(58) Field of Classification Search
CPC ..... E04B 2002/0252; E04B 2002/7446; E04B 2/18; E04B 2/20; E04B 2/24; E04B 2/32;
(Continued)

(56) References Cited

U.S. PATENT DOCUMENTS 3,180,059 A * 4/1965 Persak, Jr. ..... E04B 2/18 52/503
3,292,331 A * 12/1966 Sams ..... E04B 2/10 52/439
(Continued)

FOREIGN PATENT DOCUMENTS

CN 102661017 A 9/2012
CN 103403277 A 11/2013
(Continued)

OTHER PUBLICATIONS

International Search Report and Written Opinion in corresponding International Application No. PCT/FI2019/050594 dated Dec. 11, 2019 (12 pages).
(Continued)

*Primary Examiner* — Jessica L Laux
(74) *Attorney, Agent, or Firm* — Jeffri A. Kaminski; Venable LLP

(57) ABSTRACT

A method and a module system for building purposes by using a module system is provided, said module system including a plurality of mutually equal-sized basic components, which are assembled for a wall structure in one or more vertical planes by installing the same in connection with each other side by side and on top of each other. The wall structure is put together from substantially thin-walled basic components, which are open at ends thereof opposite in a lengthwise direction thereof and have an open internal space, and which are coupled to each other side by side and on top of each other with connection pieces capable of being connected with a first form locking joint to lengthwise
(Continued)

Figure 1A:
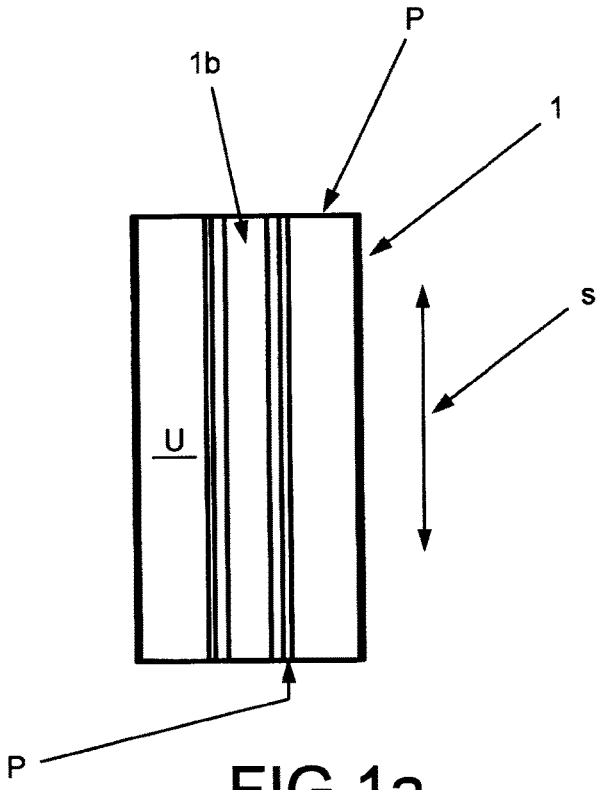

coupling arrangements present on each external side thereof. The basic components are coupled to each other with an end block interconnecting the basic components by the opposite ends thereof.

10 Claims, 8 Drawing Sheets

(51) Int. Cl.
*E04B 1/08* (2006.01)
*E04B 2/20* (2006.01)
*E04B 2/02* (2006.01)

(52) U.S. Cl.
CPC ..... *E04B 2001/5881* (2013.01); *E04B 2002/0252* (2013.01)

(58) Field of Classification Search
CPC . E04B 2/34; E04B 2/38; E04B 2/7425; E04B 2001/1957; E04B 2001/2454; E04B 2001/2478; E04B 2001/2433; E04B 2001/2448; E04B 2001/5881; E04B 2001/3583; E04B 1/58; E04B 1/5831; E04B 1/585
See application file for complete search history.

(56) References Cited

U.S. PATENT DOCUMENTS 6,050,044 A * 4/2000 McIntosh ..... A63H 33/082 446/124
6,189,282 B1 2/2001 VanderWerf
6,648,715 B2 * 11/2003 Wiens ..... A63H 33/062 446/124
8,671,640 B1 * 3/2014 Thomas ..... E04B 2/18 52/607
8,789,325 B2 * 7/2014 Verhaeghe ..... E04B 2/705 52/561
9,409,099 B2 * 8/2016 Sokolov ..... A63H 33/08
2014/0230357 A1 * 8/2014 Kovitch ..... E04B 2/08 52/588.1
2019/0127978 A1 * 5/2019 Lacroix ..... E04C 3/06

FOREIGN PATENT DOCUMENTS

CN 106638963 A 5/2017
CN 107532421 A 1/2018
GB 2443630 A 5/2008
GB 2500331 A 9/2013
WO 2013042150 A1 3/2013
WO 2018163033 A1 9/2018

OTHER PUBLICATIONS

Chinese Office Action and Search Report in corresponding Chinese Application No. 201980062947.6 dated Apr. 20, 2022 (24 pages).
European Search Report and Search Opinion in corresponding European Application No. 19865639.9 dated Apr. 28, 2022 (5 pages).

* cited by examiner

METHOD AND MODULE SYSTEM FOR BUILDING A WALL STRUCTURE

CROSS-REFERENCE TO RELATED APPLICATIONS

This application is a U.S. National Stage application of PCT/FI2019/050594, filed Aug. 21, 2019 and published on Apr. 2, 2020 as WO 2020/065125, which claims the benefit of Finnish Patent Application No. 20185797 filed Sep. 25, 2018, all of which are hereby incorporated by reference in their entireties.

The invention relates to a method and a module system for building purposes as set forth in the preambles of independent claims directed thereto.

When assembling e.g. brick structures, the question is basically about using a module system, the bricks being assembled for a wall structure in one or more vertical planes by laying the same side by side with and on top of each other and by plastering the same to each other with mortar. The wall structure obtained thereby is both massive and load-bearing, such that no support is needed with various bracing members as the bricks have been laid in the wall structure in a staggered manner, i.e. with so-called offset lap joints halfway on top of each other.

A problem with the use of bricks, especially in so-called temporary or hasty construction projects, is the considerable weight of bricks and mortars, generating logistical problems especially in challenging projects such as in developing countries or catastrophic conditions, in addition to which the erection of such structures requires abundantly both manual work and water. Therefore, in practice, the use of water in demanding projects generally calls for special arrangements which are at least difficult to carry out. It is further necessary in relation to brick wall structures that other features possibly needed in a wall structure, such as heat or sound insulation, HVAC technology, internal/external cladding or the like, be implemented with superimposed extra structures separately mountable on the brick wall.

On the other hand, the module system principle is also known from e.g. LEGO or DUPLO bricks used as toy accessories, which are based on basic blocks of equal size made of plastic and attached to each other with a form locking joint present on the top and bottom surfaces thereof and implemented with a projection-recess principle.

Since the discussed blocks are only coupled to each other over the top and bottom surfaces thereof, it is necessary for sufficient stability that the structures to be assembled thereof shall be put together in the above-explained manner, with a so-called staggered brick pattern. However, constructions based on such blocks are not, even in larger sizes, applicable as such to actual building purposes because this would additionally necessitate fastening the blocks to each other by adhesive bonding, which is why the erection of wall structures, or e.g. whole buildings, would become disproportionately slow and expensive.

U.S. Pat. No. 8,671,640 further relates to a module system used for building purposes, which includes a plurality of basic components of equal size for assembling one or more wall structures in vertical plane by placing the same side by side and top of each other in connection with each other. The discussed module system comprises substantially thin-walled basic components, which are open at the lengthwise opposite ends thereof and provided with an open internal space, and which are connectible to each other side by side and on top of each other with coupling elements connectible with a form locking joint to lengthwise coupling arrangements included in each external side thereof. The discussed solution is based on a locking pin-hole arrangement bonding basic components to each other in a lengthwise direction thereof by means of coupling elements, both the mounting and, if necessary, the dismounting of which at an assembly site, or particularly on a construction site, is unduly laborious and slow.

It is an objective of the present method and module system developed for building purposes to provide a decisive improvement regarding the foregoing problems and to thereby raise substantially the prior art. In view of attaining this objective, the method and the module system of the invention are principally characterized by what is presented in the characterizing clauses of the independent claims directed thereto.

One of the most noteworthy benefits gained by a method and module system of the invention is the simplicity of the mounting of and components included in wall structures to be assembled with the module system, enabling on the one hand an extremely simple execution of logistical arrangements required by particularly demanding projects, on the one hand by virtue of the light masses of components included in the module system and, on the other hand, the assembly being carried out without tools and liquid media. Since the wall structure, consisting of the module system, includes hollow internal spaces extending continuously in superjacent basic components in a vertical direction of the wall structure, it is possible to fill the wall structure at least partially by supplying the internal spaces of the superjacent basic elements, by way of respective coupling holes included in an intermediate piece, with a filler material such as sand, an insulation material such as polyurethane, a runny binding material such as concrete, and/or the like, in addition to which the wall structure is capable of being provided with HVAC and/or sprinkler technology etc. by using intra-wall structure conduit and wire installations.

As the basic components making up the wall structure are by all sides and ends thereof in mechanical coupling with adjacent or superjacent basic elements, there will be obtained a very solid structure, in addition to which it is further possible that the wall structure assembled from basic components and end blocks with connection pieces be bonded together by means of binding elements extending in a vertical direction of the wall structure through the internal spaces thereof and respective coupling holes included in the end blocks, such as by means of steel bars capable of being twisted to a specific torsion or in a similar manner.

From the standpoint of costs, the components included in a module system of the invention provide a possibility of being manufactured in a quite affordable manner and with optimal fabrication material consumption, e.g. by means of an extruder from a plastic-based material such as e.g. polypropylene. On the other hand, the invention has major significance also from the standpoint of environmental protection as it provides a possibility of reducing significantly the waste to be disposed at a landfill site by fabricating the components included in a module system e.g. from a synthetic and/or bio-based recycled material, a reusable plastic-based material, and/or e.g. a biodegradable material which, in practice, can be synthetic or organic.

Other preferred embodiments for a method and a module system of the invention are presented in the dependent claims directed thereto.

Figure 1B:
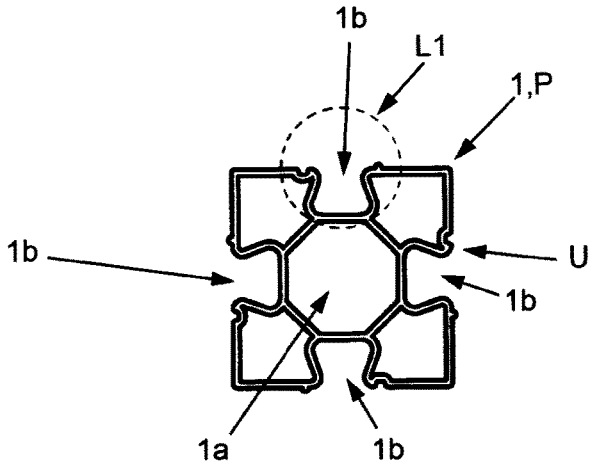
Figure 1C:
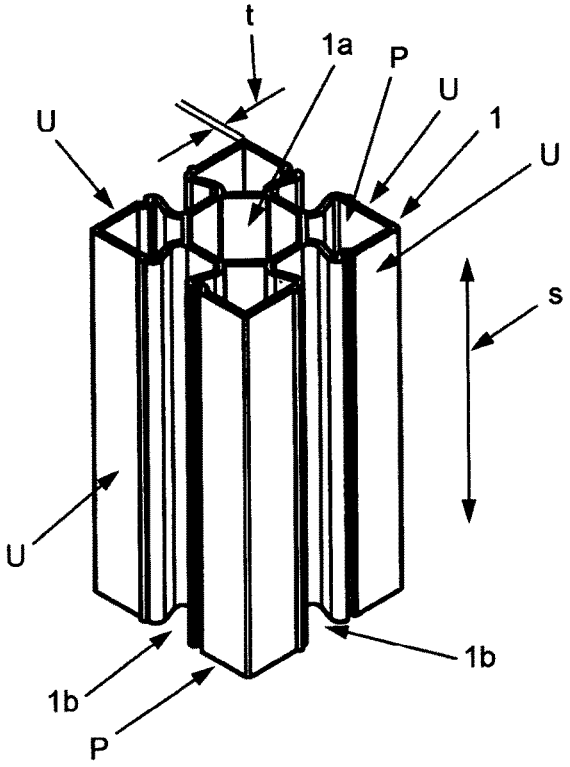
Figure 2A:
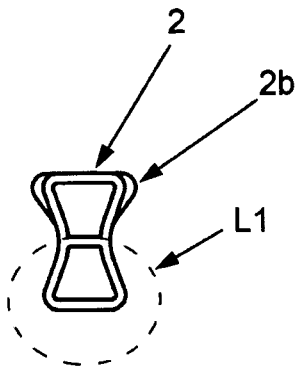
Figure 2B:
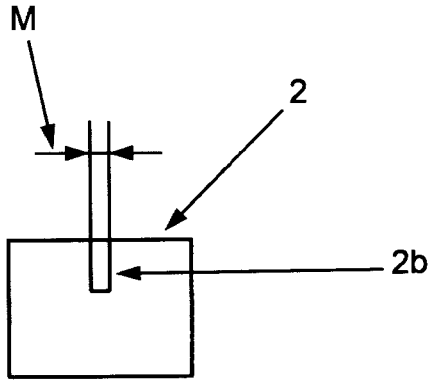
Figure 2C:
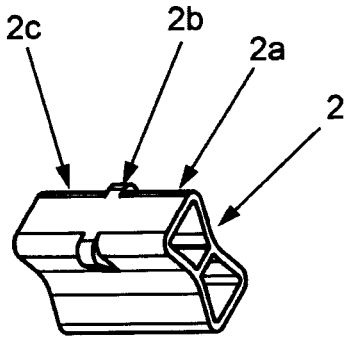
Figure 2D:
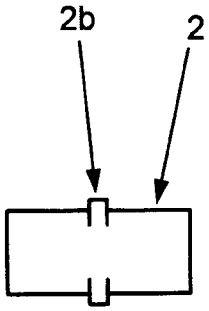
Figure 3A:
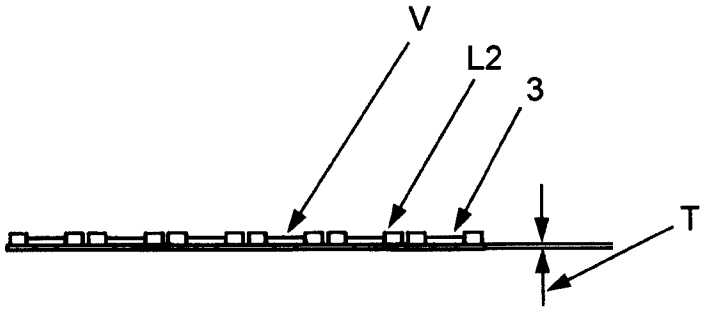
Figure 3B:
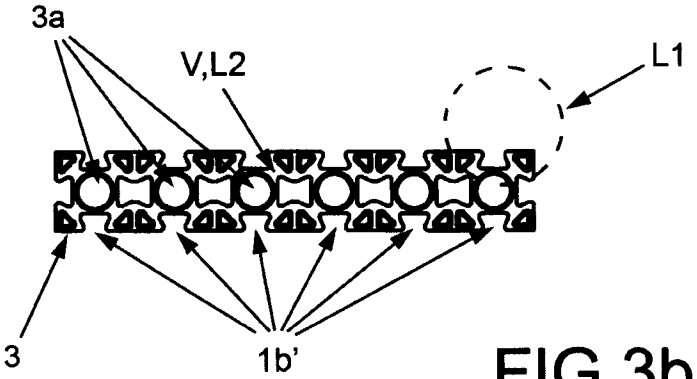
Figure 3C:
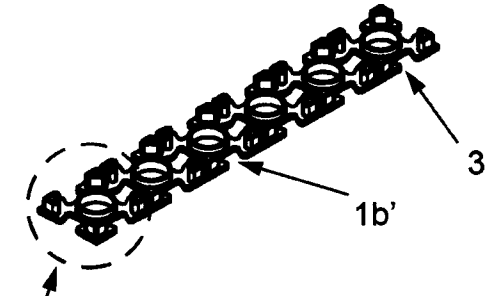
Figure 4C:
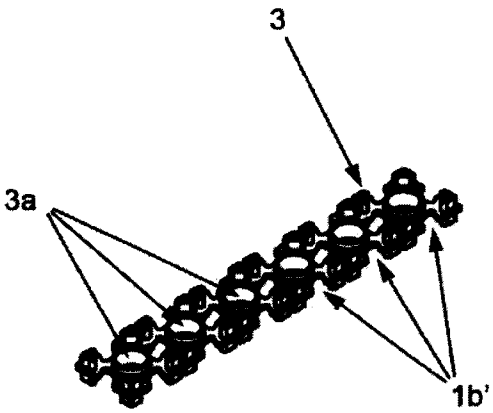
Figure 4A:
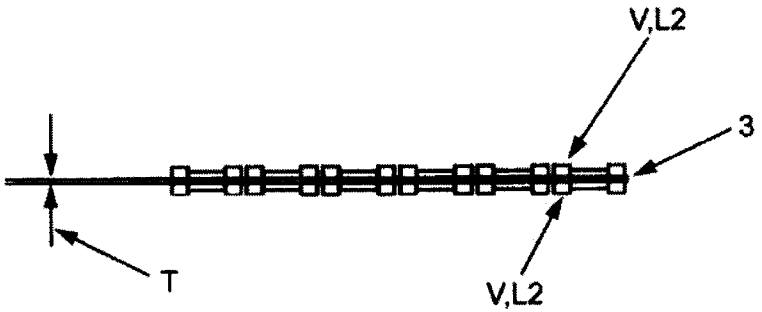
Figure 4B:
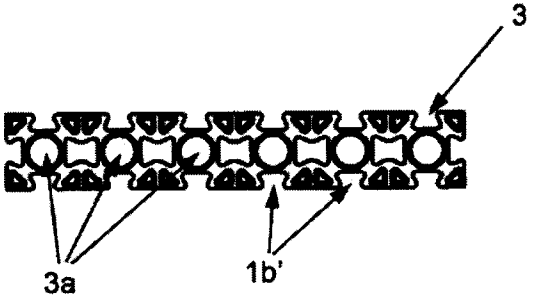
Figure 5A:
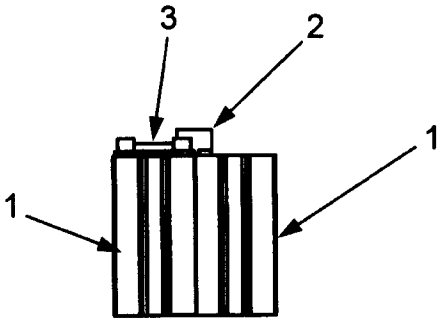
Figure 5B:
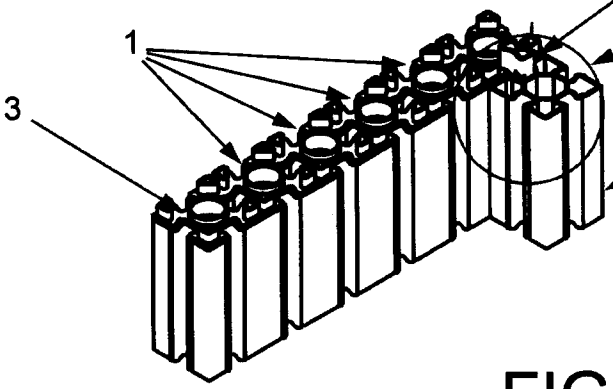
Figure 5C:
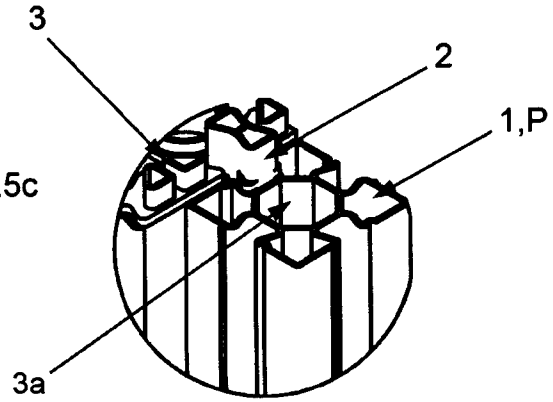
Figure 6:
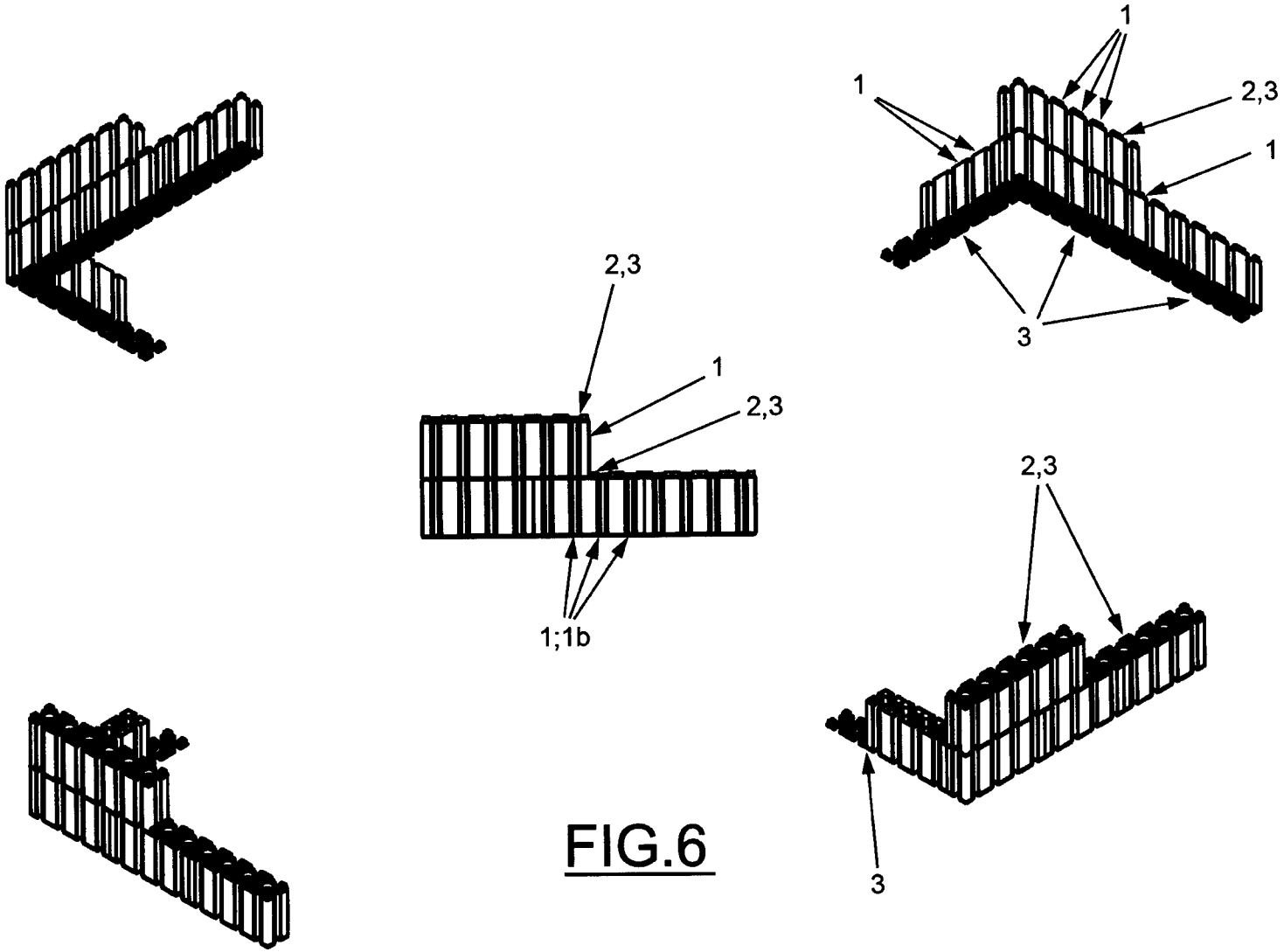
Figure 7:
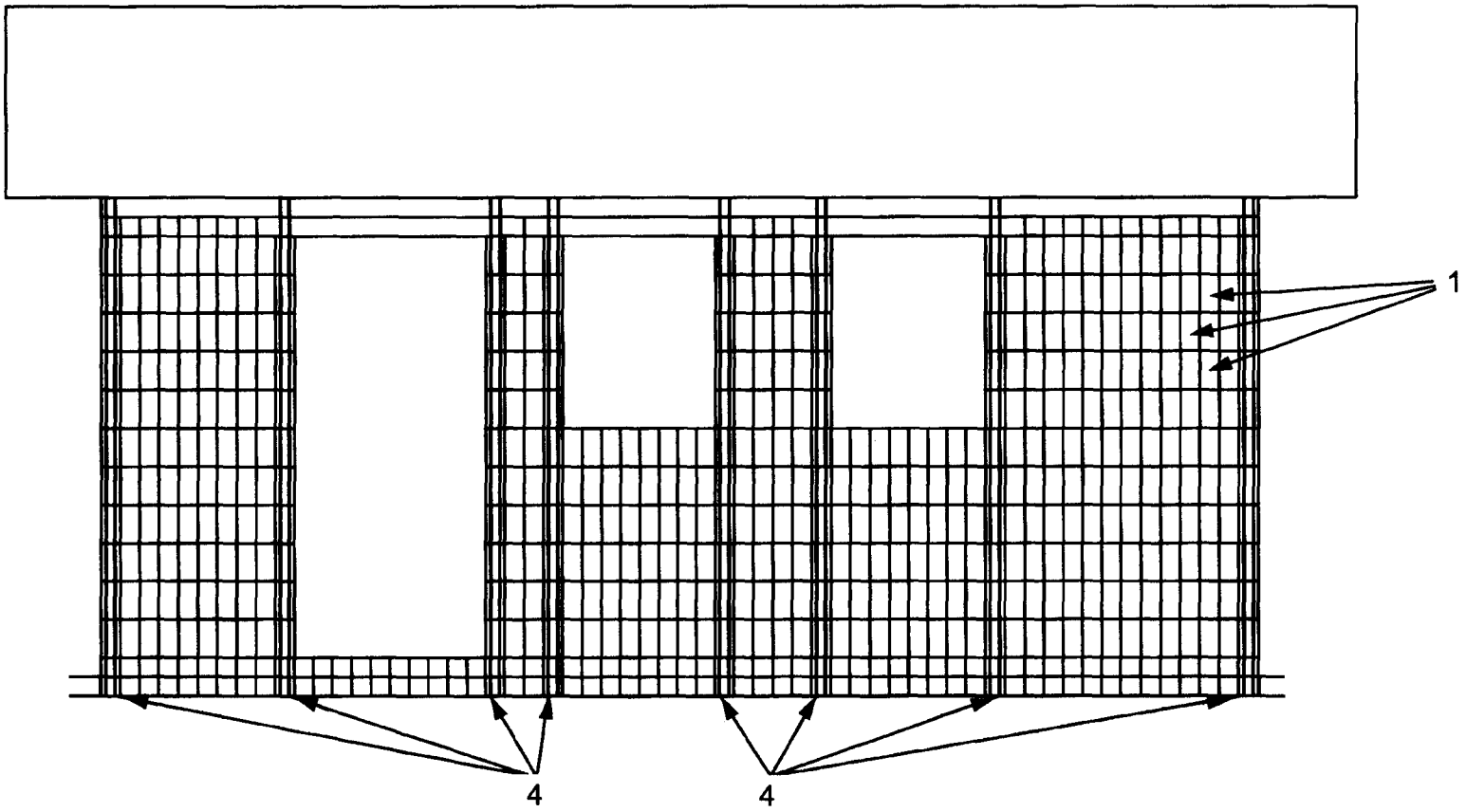
Figure 8B:
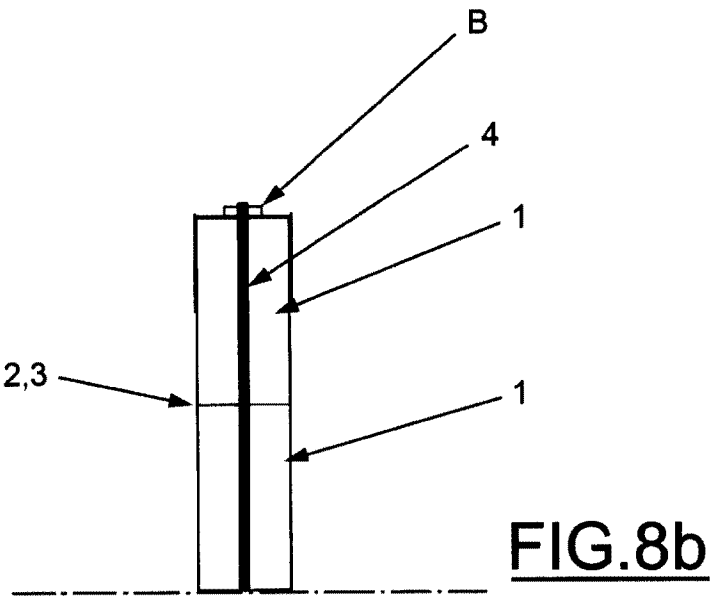
Figure 8C:
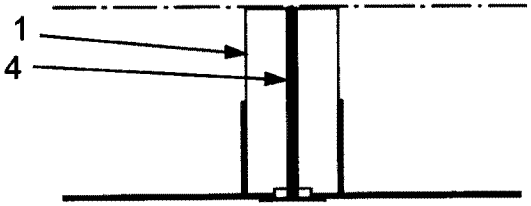
Figure 8A:
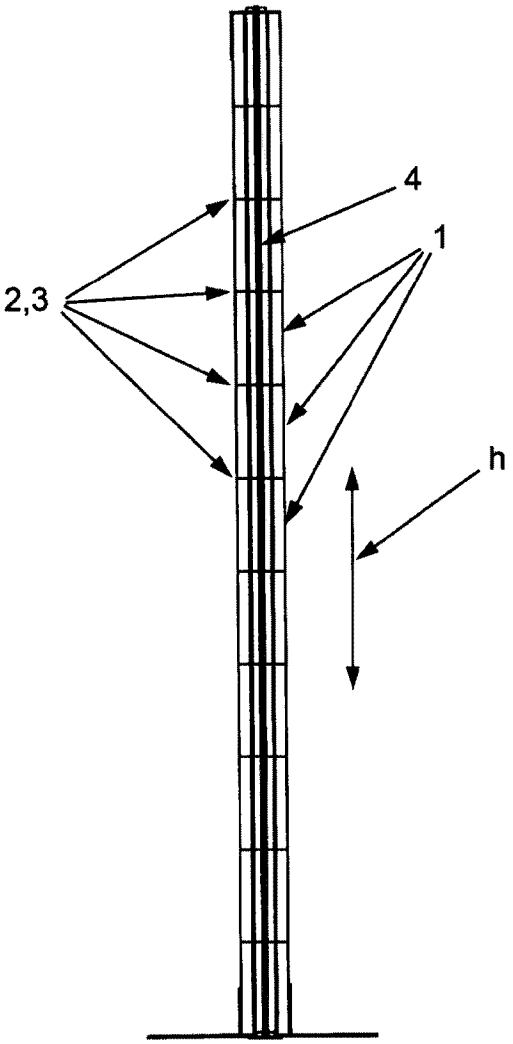

It is in the subsequent specification that the invention will be described in detail while referring to the accompanying drawings, in which FIGS. 1*a*-1*c* shows one preferred basic component included in a module system of the invention in a side view, in a top view and in a perspective view, FIGS. 2*a*-2*d* show one preferred connection piece included in a module system of the invention in a top view, in a side view, in a perspective view and in a front view, FIGS. 3*a*-3*c* show one end block included in a module system of the invention in a top view, in a side view and in a perspective view, FIGS. 4*a*-4*c* show one end block optional with respect to that depicted in FIGS. 3*a*-3*c*, FIGS. 5*a*-5*c* show, in a front view, in a perspective view and in an enlarged detail, a process of constructing an orthogonal joint in a wall structure section made up of basic components, connection pieces and end blocks, FIG. 6 shows a wall structure section compiled with end blocks and connection pieces in views from various directions, FIG. 7 shows an exemplary front view of a building put together with the module system, and FIGS. 8*a*-8*c* show one preferred wall structure assembled with a method of the invention in a cross-section view and in an enlarged detail.

The invention relates first of all to a method for building purposes by using a module system, said module system including a plurality of mutually equal-sized basic components, which are assembled for a wall structure in one or more vertical planes by installing the same in connection with each other side by side and on top of each other. The wall structure is put together from substantially thin-walled t basic components 1, which are open at ends P thereof opposite in a lengthwise direction s and have an open internal space 1*a*, and which are coupled to each other side by side and on top of each other with connection pieces 2 capable of being connected with a first form locking joint L1 to lengthwise s coupling arrangements 1*b* present on each external side U thereof. The basic components 1 are coupled to each other, in a principle apparent e.g. from FIGS. 5*a* and 6, with an end block 3 interconnecting the basic components by the opposite ends P thereof and having, referring especially to FIGS. 3*a*-3*c*, one, or referring to FIGS. 4*a*-4*c*, each of its opposite external surfaces V provided with a form locking surface L2 attaching to the end faces of two or more basic components, and each of its sides with a groove 1*b*' corresponding in shape to the first form locking joint L1.

In a further preferred embodiment for a method of the invention, the basic components 1 to be installed in the wall structure on top of each other are coupled to each other by mounting a connection piece 2 as shown e.g. in FIGS. 2*a*-2*d*, on a principle appearing e.g. from FIG. 5*c*, by its first end 2*a* on a top edge of the coupling arrangement 1*b*, such as a lengthwise s sliding groove, present on the external side U of an underlying basic component, whereby the connection piece, by reason of a stop 2*b* included therein, protrudes by its second end 2*c* above the end block 3 to be placed upon a top edge of the underlying basic component, after which the basic component to be mounted above the discussed basic component is set in position by its bottom edge by pressing its coupling arrangement 1*b* upon the second end 2*c* of the connection piece.

In a further preferred embodiment for a method of the invention, the wall structure assembled from the basic components 1 and the end blocks 3 with the connection pieces 2 is bonded together in a vertical direction h, on a principle appearing especially from FIGS. 7 and 8*a*, 8*c*, with binding elements 4 passing through the internal spaces 1*a* thereof and respective coupling holes 3*a* included in the end blocks, such as with steel bars capable of being twisted to a specific torsion or in a similar manner. The above-discussed principle is particularly evident from FIGS. 8*a*-8*c*, according to which the steel bars connected with threading to a wall structure supporting frame are twisted to a desired torsion with a nut B at the top edge thereof.

In a further preferred embodiment for a method of the invention, the wall structure assembled from the basic components 1 and the end blocks 3 with the connection pieces 2 is filled at least partially by supplying the internal spaces 1*a* of the superjacent basic elements, by way of the respective coupling holes 3*a* included in the end blocks 3, with a filler material such as sand, an insulation material such as polyurethane, a runny binding material such as concrete, and/or the like, and/or is provided with internally installed HVAC technology or the like. The above operations are capable of being easily performed on-site without needing special equipment base or machine power. FIG. 6 shows from various directions a wall section assembled as described above.

On the other hand, the invention relates also to a module system for applying the above-discussed method, said system comprising a plurality of mutually equal-sized basic components for assembling one or more wall structures in vertical plane by installing the same in connection with each other side by side and top of each other. The module system comprises, referring particularly e.g. to FIGS. 1*a*-1*c*, substantially thin-walled t basic components 1 which are open at ends thereof opposite in a lengthwise directions and have an open internal space 1*a*, and which are capable of being coupled to each other, on a principle appearing e.g. from FIGS. 5*a*-5*c* and 6, side by side and on top of each other with connection pieces 2, one preferred example of which is depicted in FIGS. 2*a*-2*d* and which are capable of being connected with a first form locking joint L1 to lengthwise s coupling arrangements 1*b* included in each external side U thereof. The module system further includes end blocks 3, preferably of a type presented e.g. in FIGS. 3*a*-3*c* and 4*a*-4*c*, for coupling the basic components 1 to each other by opposite ends P thereof with a form locking surface L2, which is present on one (FIGS. 3*a*-3*c*) or each opposite external surface V (FIGS. 4*a*-4*c*) of the end blocks and which attaches to the end faces of two or more basic components, whereby each side of the end blocks is provided with a groove 1*b*' corresponding to the first form locking joint L1. It is natural that, with respect to the side thereof opposite to the form locking surface, the topmost and/or bottommost end blocks 3 of the wall structure can be completely flat and/or without holes.

In a further preferred embodiment for a module system of the invention, referring particularly to FIGS. 2*a*2*d*, the connection piece 2 has a first end 2*a*, a stop 2*b*, and a second end 2*c* for coupling to each other the basic components 1, installable on top of each other in the wall structure, by mounting the connection piece's first end 2*a*, as presented especially in FIGS. 5*a* and 5*b*, on a top edge of the coupling arrangement 1*b*, such as a lengthwise s sliding groove, present on an external side U of the underlying basic component, for installing the connection piece so as to protrude by its second end 2*c* above an end block 3 to be placed on top of the underlying basic component's top edge, and for setting the basic component to be mounted above the underlying basic component in position by a bottom edge thereof by pressing its coupling arrangement 1*b* upon the connection piece's second part 2*c*. In this context, in a further preferred embodiment, the connection piece 2 has a length M of its stop 2*b* matching a thickness T of the end block 3.

In a further preferred embodiment for a module system of the invention, its basic components 1, extending in the lengthwise direction s thereof with a constant cross-section, its connection pieces 2 and/or end blocks 3 are made from a light metal, plastic, plastic- or bio-composite, ceramic material and/or an organic material.

With regard to practical logistics arrangements, the size of connection pieces is preferably such that the basic components have a cross-sectional dimension of 100 mm×100 mm and a height of 200 mm. Respectively, the end blocks 3 are preferably in practice constructed, as shown e.g. in FIGS. 3*a*-3*c*, for the coupling of six basic elements, i.e. so as to measure 600 mm. In view of various practical needs, it is possible that the cross-sectional dimensions of basic elements and the length of basic elements be varied as most appropriate for a given application.

It is obvious that the invention is not limited to the above-described or -explained embodiments but can be varied within the basic inventive concept in a multitude of ways, depending e.g. on the fabrication materials of components used in the invention at a given time. Accordingly, it is first of all evident that the components included in the module system are capable of being manufactured from a most diverse range of materials by making use of a manufacturing technique most appropriate for each application, e.g. from partially dissimilar materials, such as e.g. from plastic by injection molding or casting, from metal by casting or milling, from wood or stone by milling, etc. It is also possible to utilize the invention e.g. with a module system in which the structures of one or more connection pieces and end blocks are implemented with a single integrated connection piece or end block. On the other hand, it is also possible in the invention to utilize connection pieces without a stop, which enables adjacent basic components to be coupled by the mid-sections of the external sides. In addition, the internal space of basic components included in the module system can in terms of its cross-section be substantially other than round and/or it may comprise an internal space filling uniformly the basic component's outer circumference, such that the walls interconnecting the same and those parts that make up so-called coupling grooves are provided with holes. The components for a module system of the invention are further capable of being fabricated e.g. from a pulp material, such as paper, board pulp, coated with an appropriate material as necessary, or from some other organic material.

The invention claimed is:

1. A method for assembling a wall structure with a plurality of mutually equal-sized and substantially thin-walled basic components, the method comprising:

assembling the basic components in one or more vertical planes to form the wall structure by coupling the basic components to each other side by side and on top of each other with connection pieces, wherein the basic components are open at ends opposite in a lengthwise direction and have an open internal space that is in communication with the open ends, wherein each of the basic components has an essentially round internal space and a height of at least twice the cross-sectional dimension thereof, wherein the connection pieces are capable of being connected with a first form locking joint to lengthwise coupling arrangements present on each external side of the basic components, wherein the basic components and the connection pieces are made from biocomposite comprising a reusable plastic material and an organic material;

interconnecting the basic components with end blocks by opposite ends of the end blocks, wherein at least one of opposite external surfaces of the end blocks is provided with a form locking surface and at least one of external sides of the end blocks is provided with a groove corresponding in shape to the first form locking joint, and wherein each of the end blocks includes a respective coupling hole; and filling the wall structure, assembled from the basic components and the end blocks with the connection pieces, at least partially by supplying the internal spaces of superjacent basic components, by way of the respective coupling holes included in the end blocks, with at least one of a filler material, an insulation material and a runny binding material.

2. A method according to claim 1, wherein the basic components of the wall structure are bonded together in a vertical direction by using binding elements passing through the internal spaces of the basic components and respective coupling holes included in the end blocks, the binding elements being steel bars capable of being tightened to a specific torque.

3. A method according to claim 1, wherein the method further comprising installing HVAC technology into the internal spaces of the basic elements, through coupling holes of the end blocks.

4. A method according to claim 1, wherein each of the basic components has a cross-sectional dimension of 100 mm×100 mm and a height of 200 mm.

5. A method according to claim 1, wherein the filler material is sand, the insulation material is polyurethane, and the runny binding material is concrete.

6. A module system for building purposes, said module system comprising:

a plurality of mutually equal-sized and substantially thin-walled basic components for assembling one or more wall structures in vertical plane by installing the basic components in connection with each other side by side and on top of each other with connection pieces, the basic components are open at ends opposite in a lengthwise direction and have an open internal space that is in communication with the open ends, wherein each of the basic components has an essentially round internal space and a height of at least twice the cross-sectional dimension thereof;

the connection pieces, which are capable of being connected with a first form locking joint to lengthwise coupling arrangements present on each external side of the basic components;

end blocks for coupling the basic components to each other by the opposite ends of the end blocks with a form locking surface, the form locking surface is present on one or each opposite external surface of the end blocks, whereby the end blocks have at least one side provided with a groove corresponding to the first form locking joint, wherein each of the end blocks includes a respective coupling hole, wherein the basic components, the end blocks and the connection pieces are made from biocomposite comprising a reusable plastic material and an organic material, and wherein the open internal spaces of the basic components and end blocks of the assembled wall structure are at least partially filled with at least one of a filler material, an insulation material and a runny binding material.

7. A module system according to claim 6, wherein each of the connection pieces has thin walls and a hollow structure, has a first end, a stop, and a second end for coupling the basic components with each other, by mounting a first part on a top edge of the coupling arrangement, for installing the connection piece so as to protrude by its second end above an end block to be placed on top of the underlying basic component's top edge, and for setting the basic component to be mounted above the underlying basic component in position by a bottom edge thereof by pressing its coupling arrangement upon the connection piece's second end, wherein the basic components are capable of being installed on top of each other in the wall structure.

8. A module system according to claim 7, wherein each of the connection pieces has a length of its stop matching a thickness of the end block.

9. A module system according to claim 6, wherein the basic components are bonded together with the end blocks in a vertical direction with binding elements passing through the internal spaces of the basic components and respective coupling holes included in the end blocks.

10. A module system according to claim 6, wherein the filler material is sand, the insulation material is polyurethane, and the runny binding material is concrete.

* * * * *